United States Patent [19]

Otaki

[11] 4,034,795

[45] July 12, 1977

[54] FULL-AUTOMATIC MACHINE FOR CONTINUOUSLY FORMING HORIZONTAL SPLIT MOLDS IN SO-CALLED NON-PALLET AND NON-JACKET SYSTEM

[76] Inventor: Shigeji Otaki, 508-1 Aza-Ldenoue, Taindshima, Tamukae-cho, 508-1 Aza-Idenoue, Taindshima, Tamukae-cho, Japan

[21] Appl. No.: 539,047

[22] Filed: Jan. 7, 1975

[30] Foreign Application Priority Data

| | | |
|---|---|---|
| Oct. 8, 1974 | Japan | 49-115201 |
| Oct. 8, 1974 | Japan | 49-120941 |
| Oct. 15, 1974 | Japan | 49-123627 |
| Oct. 15, 1974 | Japan | 49-123628 |

[51] Int. Cl.[2] ..... B22C 15/08; B22C 13/16; B22C 17/00

[52] U.S. Cl. ..... 164/173; 164/162; 164/182

[58] Field of Search ..... 164/195, 198, 202, 160, 164/172, 173, 180, 182, 187, 200, 201, 210, 212, 239, 213, 214, 218, 244, 385, 388, 38, 162

[56] References Cited

U.S. PATENT DOCUMENTS

| | | | |
|---|---|---|---|
| 1,021,938 | 4/1912 | MacKay | 164/182 |
| 3,205,542 | 9/1965 | Miller | 164/187 |
| 3,220,066 | 11/1965 | Hatch | 164/173 |
| 3,381,740 | 5/1968 | Janke | 164/173 |
| 3,556,196 | 1/1971 | Buhler | 164/187 X |
| 3,760,866 | 9/1973 | Larkin | 164/200 |

*Primary Examiner*—Francis S. Husar

*Assistant Examiner*—John S. Brown

*Attorney, Agent, or Firm*—McGlew and Tuttle

[57] ABSTRACT

A vertical type machine for continuously forming casting molds at high pressure. The machine is supported by a bed plate and has stays extending vertically with a stationary upper frame connected to the stays. An upper mold frame is fixed to the stays while the lower mold frame is mounted on the stays for vertical reciprocation. A match plate is supported on the stays intermediate the upper and lower mold frames for movement in and out of closing engagement with the upper mold frame. The lower mold frame is mounted on horizontally extending rails on its support so that it may be moved into and out of alignment with the upper mold frame. An upper piston-cylinder actuator is mounted of the stationary frame for vertically displacing an upper squeeze plate, and a lower piston-cylinder actuator is mounted on the bed plate for moving a lower squeeze plate vertically. A sand tank is mounted on the stationary frame and its lower end is bifurcated to form branch pipes having discharge outlets which are registrable with ports formed in the upper and lower mold frames for blowing of sand into the mold frames. The upper and lower formed sand molds, after compression by the squeeze plates and retraction of the match plate, are extruded by the upper squeeze plate downwardly through the lower mold frame onto the lower squeeze plate, and are then moved forwardly onto a teeming platform extending forwardly from the assembly. As each horizontal split mold is moved onto the teeming table, its forward surface is bonded to the rearward surface of the immediately preceding mold.

4 Claims, 9 Drawing Figures

FULL-AUTOMATIC MACHINE FOR CONTINUOUSLY FORMING HORIZONTAL SPLIT MOLDS IN SO-CALLED NON-PALLET AND NON-JACKET SYSTEM

FIELD OF THE INVENTION

This invention relates to the forming of horizontal split molds in so-called non-pallet and non-jacket systems and, more particularly, to an improved fully automatic machine for continuously forming horizontal split molds.

SUMMARY OF THE INVENTION

According to the device of the present invention, raw material sand blown into an upper mold frame and a lower mold frame is squeezed by means of an the upper squeeze plate and an the lower squeeze plate and molded to form a horizontal split mold supported on the lower squeeze plate to be lowered out of the mold frames. When each sand mold is lowered to a position at the level of the upper surface of a teeming platform, it is displace forwardly and shifted onto the teeming platform. Accordingly, neither a pallet nor a jacket is required therefor. Each sand mold thus formed has its forward face bonded to the rear face of the preceding sand mold, and is in a compressed state. Therefore, during the teeming operation, no mold crush and leakage of molten bath occur. The casting operation of the so-called non-pallet, non-jacket and non-weight system can be effected, and the sand molds thus formed and bonded with adjacent ones at their adjacent surfaces are aligned with each other.

Therefore sufficient amounts of said molds can be stored at the narrowest teeming place, so that the teeming operation can be continuously carried out. In this case, at the peripheral part of the lower end of each of the sand molds, bevelled portions are formed to prevent biting of residual sand particles. Small gaps are formed between adjacent square rods of a side teeming platform so that the residual sand particles fall and no sand particles bite in the lower surfaces of the sand molds.

For an understanding of the principles of the invention, reference is made to the following description of a typical embodiment thereof as illustrated in the accompanying drawings.

DESCRIPTION OF THE PREFERRED EMBODIMENT

Figure 1:
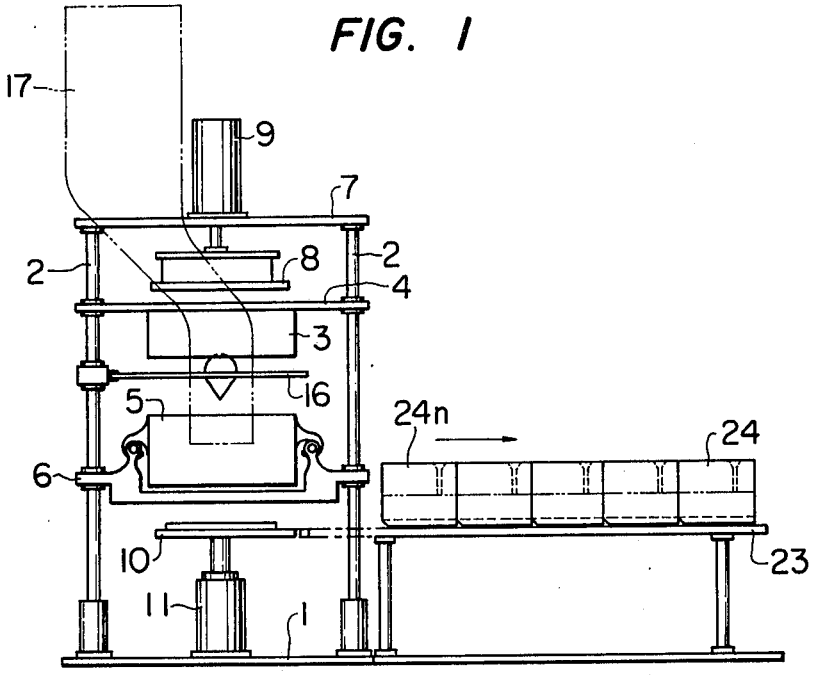
FIG. 1 is a side elevation view of the overall machine embodying the invention.
Figure 2:
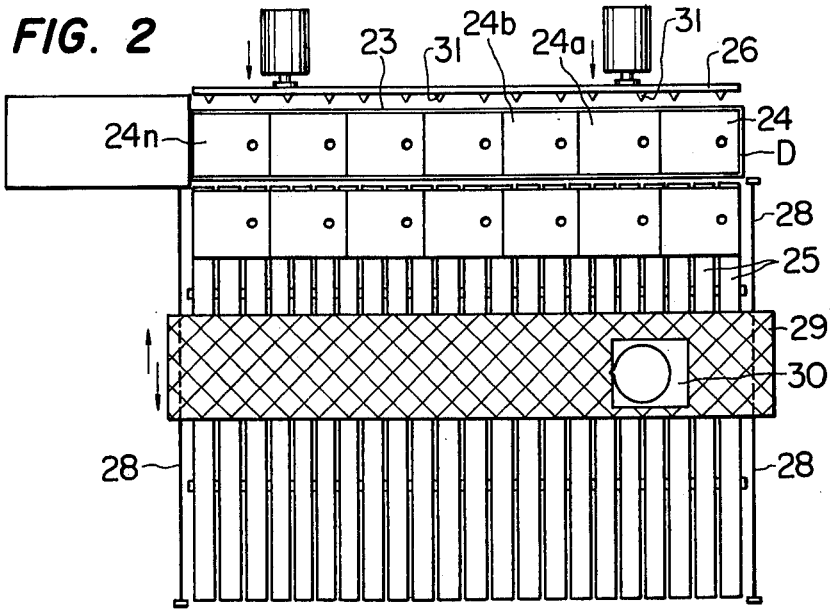
FIG. 2 is a horizontal plan view illustrating the teeming platform.
Figure 3:
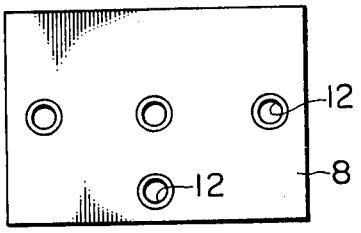
FIG. 3 is a plan view of the upper squeeze plate.
Figure 4:
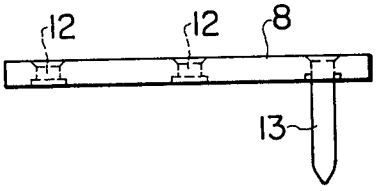
FIG. 4 is a front elevation view of the upper squeeze plate as shown in FIG. 3.
Figure 5:
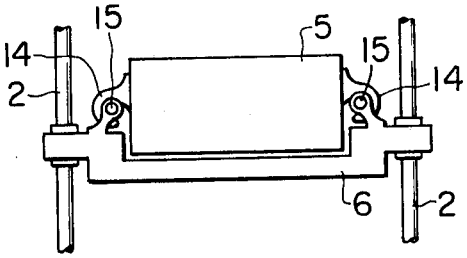
FIG. 5 is an enlarged front elevation of the lower mold frame and its support.

In the drawings, at the upper part of stays 2, 2 - - -, planted at the four-corner parts of a bed-plate 1 of the machine body, there is fixed an upper mold fitting frame 4 supporting an upper open mold frame 3. At the lower parts of stays 2, there is supported an open lower mold fitting frame 6, supporting a lower open mold frame 5, and which is displaceable along stays 2, 2 - - - in a vertically slidable manner. At the upper end parts of stays 2, there is mounted an upper stationary frame 7. At the upper surface of upper stationary frame 7, there is mounted a piston-cylinder actuator 9 shifting an upper squeeze plate 8 in a vertical direction whereas, at the lower bedplate 1, there is mounted a piston cylinder actuator 11 shifting a lower squeeze plate 10 in a vertical direction.

Figure 6:
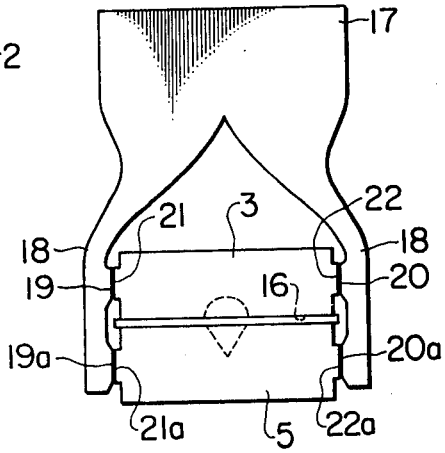
FIG. 6 is a partly enlarged elevation view illustrating the raw material sand tank and its connection to the mold frames.
Figure 7:
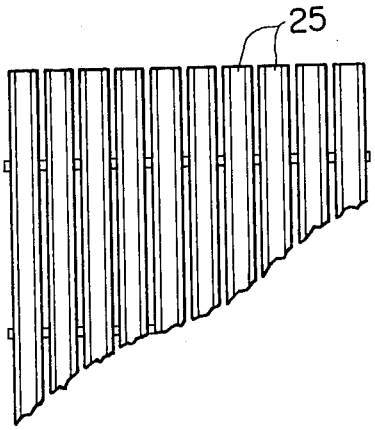
FIG. 7 is an enlarged plan view, illustrating, in more detail, the construction of the laterally extending teeming platform.
Figure 8:
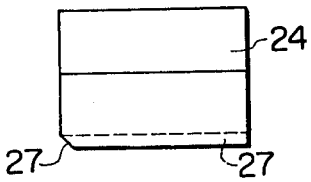
FIG. 8 is a side elevation view of a horizontal split sand mold formed with the apparatus of the invention.
Figure 9:
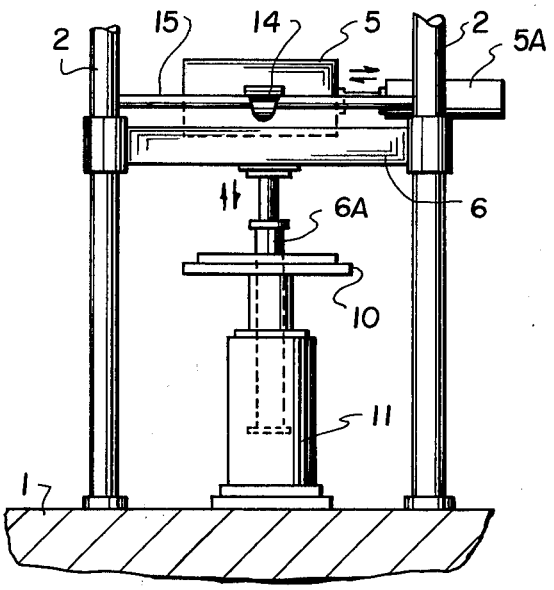
FIG. 9 is a partial front elevation view, looking from the left, of the apparatus as shown in FIG. 1.

Several through holes 12, 12 - - - are formed in upper squeeze plate 8, and a sprue forming rod 13 is fitted in one through hole, while the other unused through holes can be blocked. Furthermore, fitting members or guides 14 are secured to extend from both opposite side surfaces of said lower mold frame 5, and are engaged with and supported slidably along guide rods 15 and 15 arranged on both opposite sides of the lower fitting frame 6. Between mold frames 3 and 5, a match plate 16 is supported by a pair of rear stays 2, and may be engaged with and released from upper mold frame 3. Upper stationary frame 7 also supports a raw material sand tank 17, which is bifurcated at its lower end to form branched pipes 18 and 18. The match plate 16 is inserted laterally between upper mold frame 3 and the lower mold frame 5, and may carry core patterns on its upper surface, lower surface or both surfaces as schematically illustrated in FIGS. 1 and 6. Mold frame support 6 carrying lower mold frame 5 is vertically displaceable along stays 2 by piston-cylinder actuator 6A. At the position in which both upper and lower mold frames are abutted to each other through match plate 16, the upper openings 19 and 20 of branched pipes 18 and 18 and the lower openings **19*a* and 20*a* thereof are in sealed engagement with the blow- in ports 21 and 22 at opposite side surfaces of the upper mold frame 3 and blow-in ports 21*a* and 22*a* at opposite side surfaces of the lower mold frame 5. After the raw material sand has been blown in from opposite sides of the lower mold frame, the upper squeeze plate 8 is forced downwardly, and the lower squeeze plate 10 is forced upwardly to compress the sand and thereby to form the sand mold. After the sand has been compressed, the upper and lower open mold frames 3 and 5 are separated a distance sufficient to permit match plate 16 to be retracted laterally from between the upper and lower mold frames, together with any core patterns which may be carried by match plate 16. Lower mold frame 5 then is moved to protrude from the side of the lower fitting frame 6, and further, if necessary, a core is inserted therein. Lower mold frame 5 is laterally displaceable along guide rods 15 by a piston-cylinder actuator 5A. The lower mold frame 5 is then restored to the original position, and the upper mold and the lower mold are then directly abutted to each other. The upper and lower sand molds are pushed downward integrally by upper squeeze plate 8, and extruded downwardly from lower mold frame 5** to be pressed onto lower squeeze plate 11, which is then lowered to bring the sand mold into horizontal alignment with a teeming platform 23. Platform 23 is arranged at the front part of the machine frame, and an extruder is provided at the rear part of the machine frame. The extruder then moves the sand mold 24 onto teeming platform 23. The described cycle is then repeated and, as each sand mold is brought into alignment with teeming platform 23, its front surface is bonded to the rear surface of the immediately preceding sand mold on the teeming platform, so that a series of sand molds 24 - - - 24*n*, bonded together, are supported on forwardly extending teeming platform 23. Furthermore, in this case, the sand molds aligned on said teeming platform 23 are successively compressed by a great force and moved along platform 23. Accordingly, when these sand molds are compressed by a force more than the limit, there ensues a crush or break in the sand mold. Hence, there a predetermined restriction is placed on the number of sand molds aligned on teeming platform 23 and therefore troubles occur in the continuous operation.

Accordingly, in order to promote the working efficiency, side or lateral teeming platform sections 25, in which a large number of square or polygonal rods are aligned parallelly in a direction perpendicularly to the teeming platform 23, are provided so that they are spaced slightly from each other. A predetermined number of sand mold groups 24 aligned on teeming platform 23 are displaced laterally as a unit for transfer onto side teeming platform sections 25, through a compressing plate 26 provided on the opposite of said teeming platform 23. Then, additional sand molds are displaced onto teeming platform 23 and bonded to each other, and compressed. When a predetermined number of sand molds are aligned thereon, these sand molds are further bonded to respective side surfaces of the sand mold group line 24 which has previously been transferred onto side teeming platform section 25, and pressed by member 26 and moved along the platform sections 25.

In such an operation, the front lower end edge and side lower end edges of each sand mold are formed into bevelled portions 27 and 27, thereby to prevent biting of sand particles when the sand molds are transferred. On the front surface of plate 26 there are formed small protruded ridges 31, 31, - - - and, when the sand mold groups are transferred onto lateral teeming platform sections 25, gas vent ridges are formed on the side surface of respective sand molds. Thus, when, on the side teeming platform sections 25, there are aligned sand mold groups 24, 24*a*, 24*b* - - - 24*n*, a ladle car 30 is placed in a freely movable manner on an overhead crane or bridge 29 movable along rails 28, 28 laid on opposite of said teeming platform section 25, thereby to freely teem the aligned sand molds. As previously mentioned, in accordance with the method of the present invention, even when sand molds of complicated shape are formed, the raw material sand is blown in from opposite sides of the upper mold frame and lower mold frame. Therefore, despite the presence of a match plate between the upper mold and the lower mold, no shaped part is produced, the molds are filled with sand uniformly even at corners, and squeezed sand molds, having a uniform density and hardness at any part, are obtained, and hence, neither pallet nor jacket is required therefor. Also, in the teeming operation, since sand molds are bonded to each other at their side surfaces while compressed and aligned, there is no possibility that mold crush or leakage of the molten bath may occur. Since the upper squeeze plate is so formed that the sprue forming rod 13 can be fitted at a predetermined position thereon, a sprue can be formed in the sane blow-in process and squeezing process. In the case where it is necessary to insert the core in the machine after the match plate is pulled back, the lower mold frame is caused to slide to protude from the side of the machine body, whereby the core may be inserted accurately and quickly. Furthermore, in the front part of the machine body, a teeming platform 23 is provided and the side teeming platform sections 25 are provided one of said teeming platform, 23. The sand molds aligned on the teeming platform 23 are transferred onto the side teeming platform sections 25 through the compressing plate 26. Respective sand molds are bonded to the side surfaces of the adjacent sand molds and aligned, and hence it is possible to store a great number of sand molds in a minimum space, the teeming ladle car can be transferred on the overhead bridge or crane running on the rails 28, thereby to carry out the teeming operation. Accordingly, the operations from the forming of sand molds to the teeming can be automatically carried out, whereby the operational efficiency can be improved.

I claim:

1. A vertical type machine, for continuously forming casting molds at high pressure, comprising, in combination, a bed plate; stays extending vertically upwardly from the corners of said bed plate; an upper mold frame support secured to the upper portions of said stays; an upper mold frame secured to said upper support to extend downwardly therefrom; a lower mold frame support mounted on said stays for vertical reciprocation therealong; a lower mold frame mounted on said lower support; a match plate supported on said stays for movement into and out of closing engagement with the lower surface of said upper mold frame; a stationary frame supported on the upper ends of said stays; an upper piston-cylinder actuator mounted on said stationary frame; an upper squeeze plate movable vertically by said upper actuator; a lower piston-cylinder actuator mounted on said bed plate; a lower squeeze plate movable vertically by said lower actuator; and a raw material sand tank mounted on said stationary frame and having its lower end bifurcated to form branched pipes having sand discharge outlets; said upper and lower mold frames being formed with ports registrable with said discharge outlets for blowing of sand into said mold frames.

2. The vertical type machine, for continuously forming casting molds at high pressure, as claimed in claim 1, in which each branched pipe is formed with two sand discharge outlets, one registrable with the ports in the upper mold frame and the other registrable with the ports in the lower mold frame when said match plate is in closing engagement with the lower surface of said upper mold frame and said lower mold frame has been moved upwardly to firmly engage said match plate; said sand discharge outlets being sealed to said ports during blowing in of the sand simultaneously into both the upper mold frame and the lower mold frame.

3. The vertical type machine, for continuously forming casting molds at high pressure, as claimed in claim 1, in which said upper squeeze plate is formed with a plurality of through holes at selected locations therein; a sprue forming rod insertable in a selected one of said through holes in accordance with the shape to be molded; the unused through holes being closable by a blocking plate; said sprue forming rod being inserted in said upper mold frame during the blowing in of the sand and the squeezing of the raw material sand by said squeeze plates so that a sprue is formed in the sand mold.

4. The vertical type machine, for continuously forming casting molds at high pressure, as claimed in claim 7, including a pair of horizontally oriented guide rods mounted in spaced parallel relation on said lower mold frame support and projecting laterally beyond said stays in at least one direction; said lower mold frame having engaging members secured to a pair of opposite side surfaces thereof and extending therefrom for engaging said guide rods; the extent of projection of said guide rods being sufficient that, after charging of raw material sand into said upper and lower mold frames, and lowering of said lower mold frame support, said lower mold frame may be displaced on said guide rods laterally out of alignment with said upper mold frame for charging of a core into the sand in said lower mold frame.

* * * * *